US005620342A

United States Patent [19]

Kinross

[11] Patent Number: 5,620,342

[45] Date of Patent: Apr. 15, 1997

[54] SOCKET HAVING LOW INSERTION FORCE CONTACT SYSTEM

[75] Inventor: Timothy J. Kinross, Greensboro, N.C.

[73] Assignee: The Whitaker Corporation, Wilmington, Del.

[21] Appl. No.: 489,602

[22] Filed: Jun. 12, 1995

[51] Int. Cl.[6] ..... H01R 23/70

[52] U.S. Cl. ..... 439/637; 439/630

[58] Field of Search ..... 439/630–637, 439/326–328, 60

[56] References Cited

U.S. PATENT DOCUMENTS

| | | | |
|---|---|---|---|
| 3,193,791 | 7/1965 | Bock et al. | 439/637 |
| 4,648,668 | 3/1987 | Sinisi | 339/75 |
| 5,071,371 | 12/1991 | Harwath et al. | 439/637 |
| 5,112,231 | 5/1992 | Harwath et al. | 439/60 |
| 5,162,002 | 11/1992 | Regnier | 439/637 |
| 5,203,725 | 4/1993 | Brunker et al. | 439/60 |
| 5,263,870 | 11/1993 | Billman et al. | 439/108 |
| 5,360,346 | 11/1994 | Regnier | 439/61 |

FOREIGN PATENT DOCUMENTS

| | | | |
|---|---|---|---|
| 2615300 | 10/1976 | Germany | 439/637 |
| 1480721 | 7/1979 | United Kingdom | 439/637 |

*Primary Examiner*—David L. Pirlot
*Attorney, Agent, or Firm*—Robert J. Kapalka

[57] ABSTRACT

A socket (8) for electrically connecting a circuit card (4) to a substrate comprises a dielectric housing (10) defining a card-receiving slot (12) having a bottom surface (24) and a pair of opposite side surfaces (26, 28), and a plurality of contacts (31, 32) spaced apart along the length of the slot. The plurality of contacts include contact beams (37, 38) at least some of which extend to a greater height above the bottom surface than others of the contact beams. Each of the contact beams includes a contact section (45, 46) extending into the slot and having a card-contacting surface (47, 48) for electrically connecting with the circuit card. All of the card-contacting surfaces are at a substantially same height above the bottom surface. During insertion of the circuit card into the slot, the at least some contact beams are engaged and deflected by the circuit card before the others of the contact beams, and upon full insertion of the circuit card in the slot, each of the contact beams has a respective point of contact with the circuit card at said substantially same height.

12 Claims, 5 Drawing Sheets

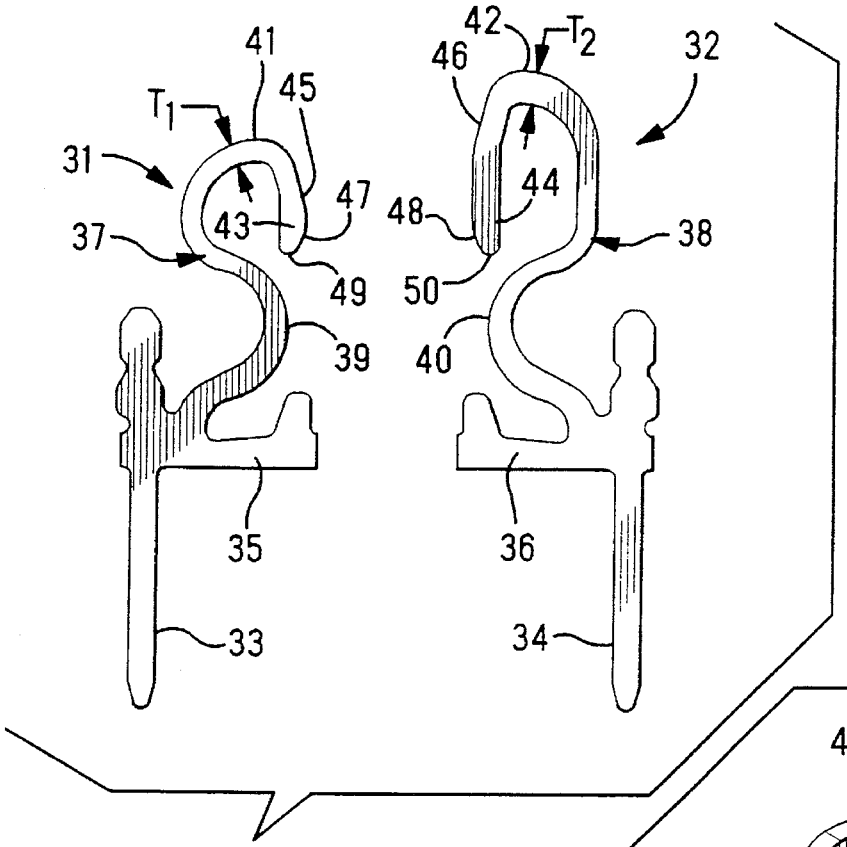
FIG. 3
FIG. 4
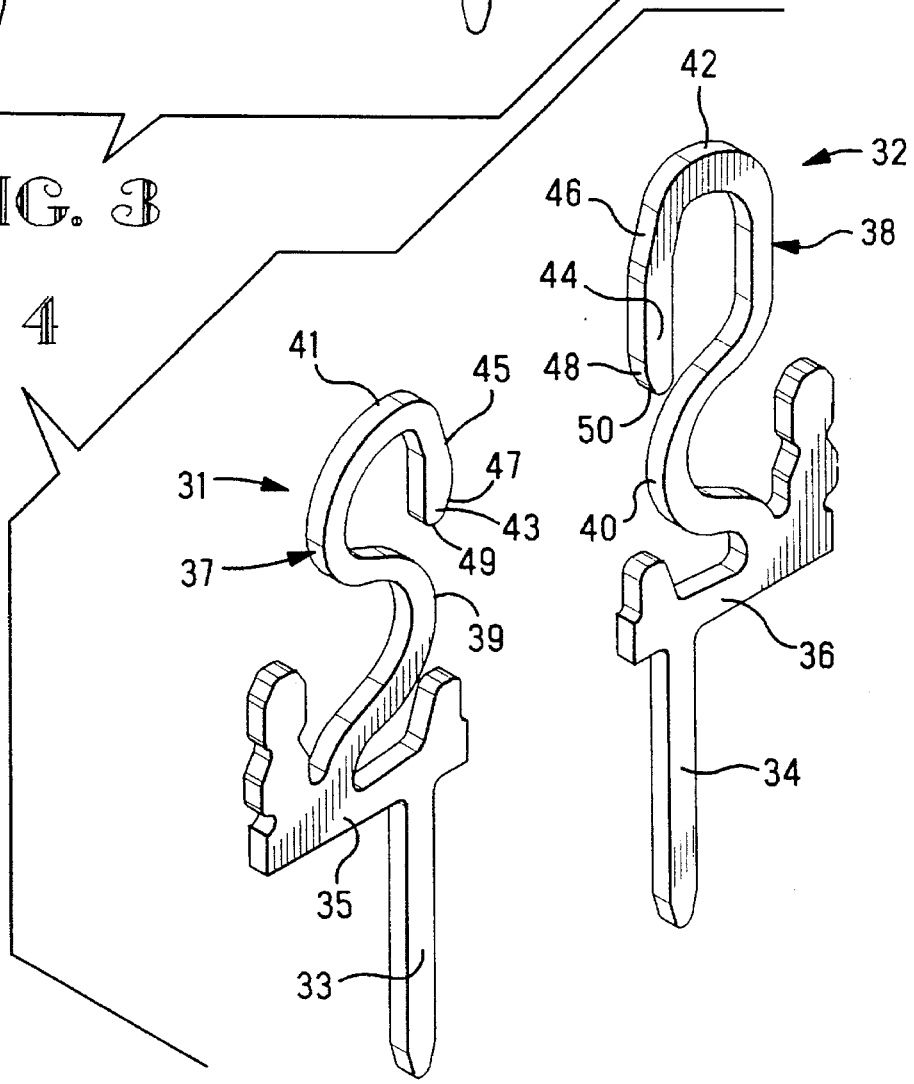

SOCKET HAVING LOW INSERTION FORCE CONTACT SYSTEM

FIELD OF THE INVENTION

The invention relates to the field of electrical connectors, and in particular, to a card edge connector of the type having a card-receiving slot and contacts spaced apart along the length of the slot for engaging contact pads on the a circuit card.

BACKGROUND OF THE INVENTION

A single in-line memory module (SIMM) comprises a circuit panel card having a plurality of integrated circuit components mounted thereon, with circuit traces extending from the components to contact pads along an edge of the card. A SIMM card has redundant sets of circuit traces and contact pads on its opposite sides, while a dual in-line memory module (DIMM) card has independent sets of circuit traces and contact pads on each of its opposite sides. Both SIMM cards and DIMM cards can be mounted as daughtercards on a circuitboard mothercard.

Sockets are well-known to receive the edge of a circuit panel daughtercard, either SIMM or DIMM, and establish an electrical interconnection with a circuitboard mothercard. These sockets have a slot for receiving the edge of the daughtercard, and contacts which extend into the slot to engage the contact pads along the edge of the daughtercard. During insertion of the daughtercard into the slot, the contacts are resiliently deflected within their individual cavities, thereby generating a normal force on the contact pads which is necessary to provide a good electrical interconnection. However, the required deflection of the contacts also generates a resistance to insertion of the card, and as the required normal force and/or the number of contacts in the socket increases, the resistance to insertion becomes quite large.

In order to alleviate the problem of insertion resistance, zero insertion force sockets have been developed. These sockets, known as pivot-in or cam-in sockets, permit a daughtercard to be inserted into the socket in an initial orientation with a zero insertion force, and then to be pivoted to a final orientation during which the contacts are more easily deflected due to a camming action of the daughtercard. A drawback of the zero insertion force sockets is that additional space is required surrounding the socket in order to permit the pivoting action of the daughtercard. In electronic devices where space is at a premium, it is often desirable to utilize straight-in, or direct insert, sockets.

The design of direct insert sockets and contacts generally involves a compromise between the opposed objectives of providing a high normal force on the contact pads while providing a low resistance to insertion of the card. A known device for reducing the insertion resistance while maintaining a desired normal force is to stagger the contacts at different heights in the socket, as disclosed in U.S. Pat. No. 5,112,231. This device is effective because insertion resistance has two components, namely deflection resistance due to spring deflection of the contacts, and friction resistance due to sliding over the contacts as the card is being inserted. The deflection resistance is generally the greater of the two, By separating the deflection of the contacts into two or more stages, the maximum insertion resistance is reduced by a significant amount. However, this device requires that the daughtercard have contact pads at two distinct levels, and results in the socket and the card having a greater height than is the case for a card which has contact pads at one level only.

The present invention provides a socket with a low insertion force contact system which reduces the insertion resistance while permitting acceptance of a daughtercard having contacts pads all at one level, thereby enabling the socket to have a low overall height.

SUMMARY OF THE INVENTION

It is an object of the invention to facilitate the insertion of a circuit card in a card edge socket.

It is a feature of the invention that contacts in a socket extend to different heights above a bottom surface of a card-receiving slot in the socket.

It is an advantage of the invention that resistance to insertion of a circuit card in the socket is reduced.

The invention provides a socket for electrically connecting a circuit card to a substrate. The socket comprises a dielectric housing defining a card-receiving slot having a bottom surface and a pair of opposite side surfaces, and a plurality of contacts spaced apart along the length of the slot. The plurality of contacts include contact beams at least some of which extend to a greater height above the bottom surface than others of the contact beams. Each of the contact beams includes a contact section extending into the slot and having a card-contacting surface for electrically connecting with the circuit card. All of the card-contacting surfaces are at a substantially same height above the bottom surface. During insertion of the circuit card into the slot, the at least some contact beams are engaged and deflected by the circuit card before the others of the contact beams, and upon full insertion of the circuit card in the slot, each of the contact beams has a respective point of contact with the circuit card at said substantially same height.

BRIEF DESCRIPTION OF THE DRAWINGS

The invention will now be described by way of example with reference to the accompanying drawings in which like elements in different figures thereof are identified by the same reference numeral and wherein:

FIG. 3 is an enlarged view of the contacts shown in FIG. 2.

FIG. 4 is an isometric view of the contacts shown in FIG. 3.

DETAILED DESCRIPTION OF THE PREFERRED EMBODIMENT

The invention will be described with reference to the drawings wherein a DIMM socket having independent contacts for engaging independent circuit traces on opposite sides of a daughtercard has been illustrated. However, it should be readily apparent to those skilled in the art that principles of the invention can be equally applied to a SIMM socket having contacts each comprising a pair of opposed contact beams which are electrically connected for engaging redundant circuit traces on the opposite sides of a daughtercard, and the description of the invention with reference to a DIMM socket is intended to be exemplary and not limiting.

Figure 1:
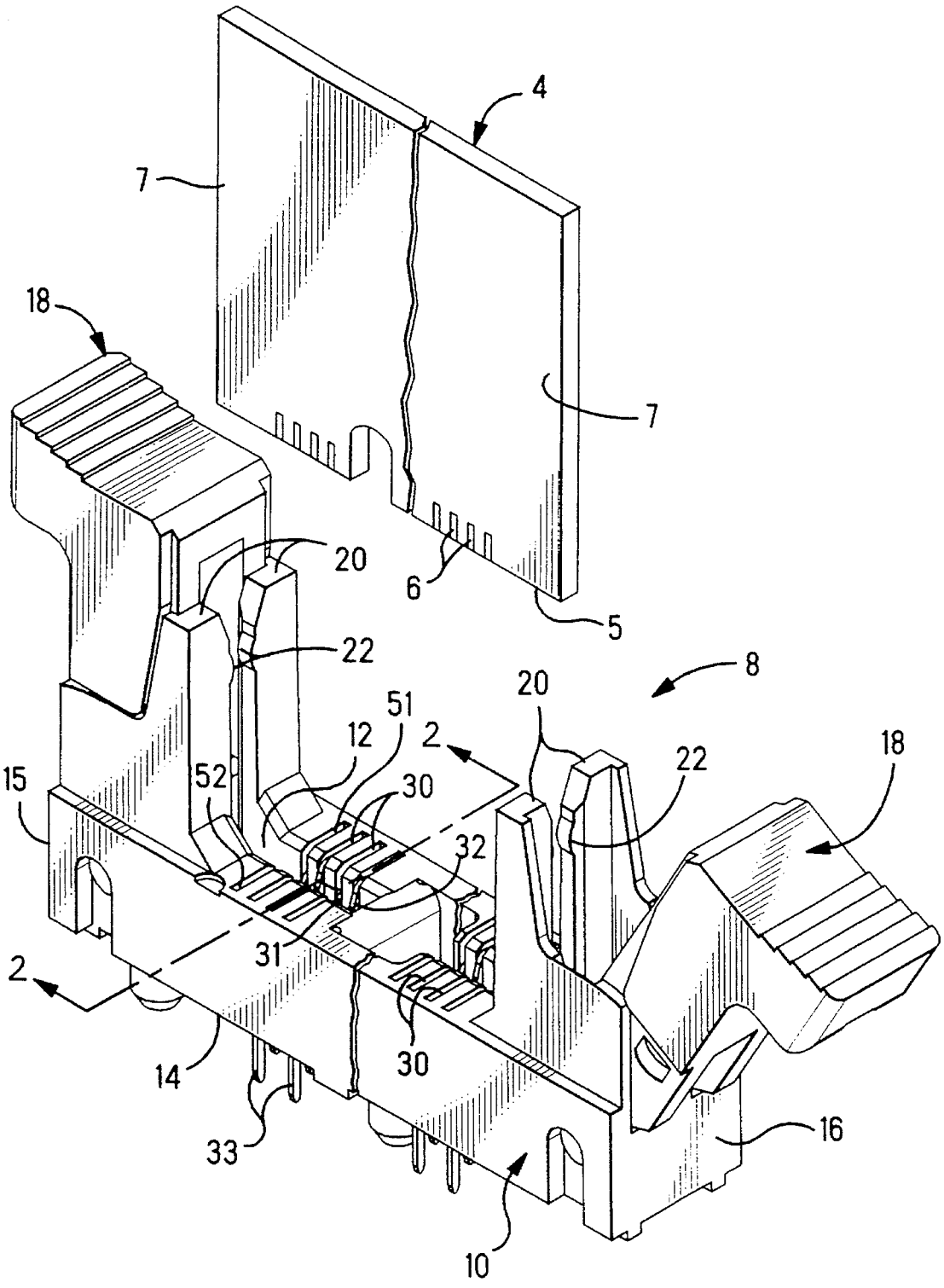
FIG. 1 is an isometric view of a socket according to the invention, and a circuit card which can be received therein.

There is shown in FIG. 1 a DIMM socket 8 for electrically interconnecting a daughtercard 4 with a mothercard (not shown) or other substrate. The daughtercard 4 has electrical contact pads 6 aligned in one horizontal row in a marginal area adjacent to a bottom edge 5 of the card. The contact pads 6 all have a uniform height from the bottom edge.

The socket 8 comprises a dielectric housing 10 having a card-receiving slot 12 extending between opposite ends 15 and 16 of the housing. At each end of the housing 12 is a pivotable latch mechanism 18 which is operable to lock the card 4 in the socket when the latch is in an upright position, and to extract the card from the socket when the latch is pivoted outwardly in the longitudinal plane of the socket. Side margins 7 of the card 4 are received between pairs of beams 20 when the bottom edge 5 is in the slot 12. The pairs of beams 20 are engageable by the respective latch mechanisms 18 so as to prevent deflection of the beams 20 and thereby stabilize the card 4 between opposed projections 22 on the beams 20.

Figure 2:
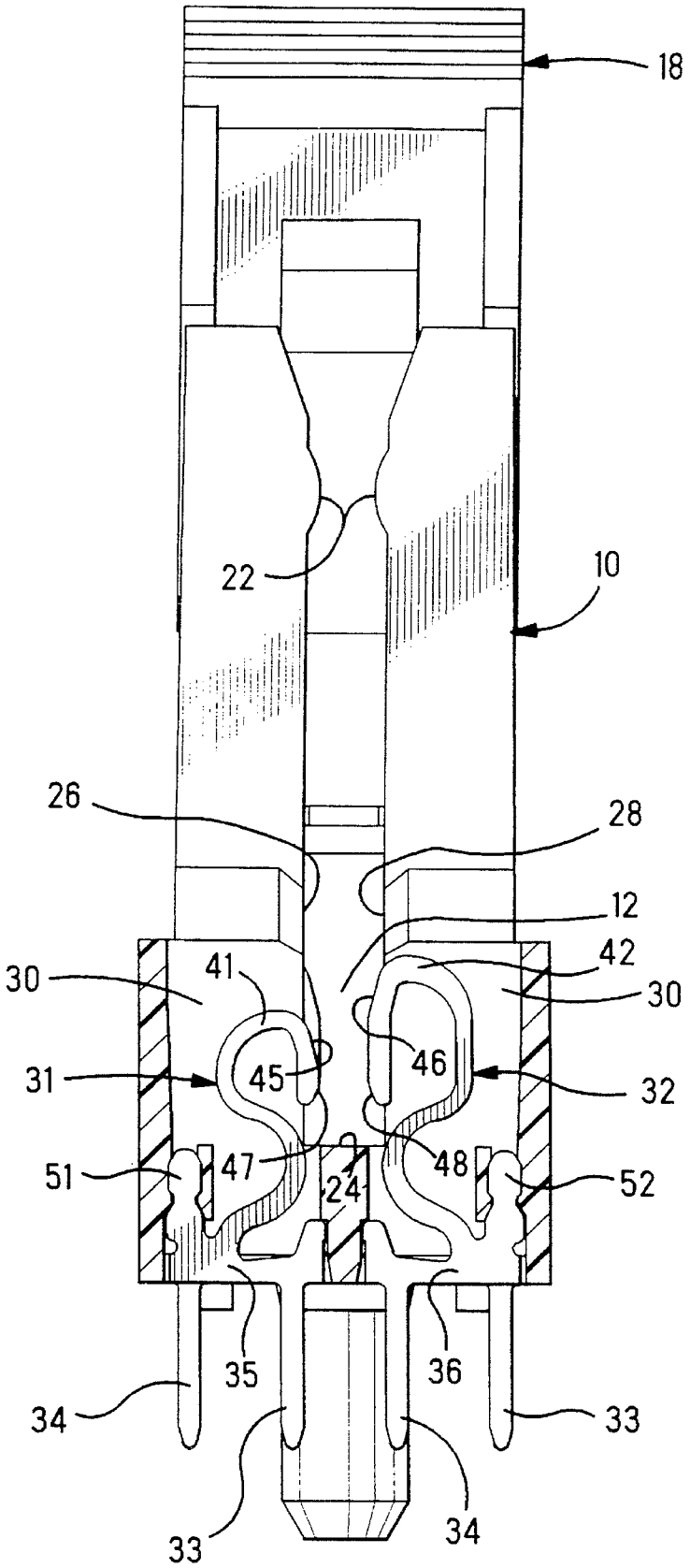
FIG. 2 is a cross-sectional view taken along line 2—2 of FIG. 1.

With reference to FIGS. 1 and 2, the slot 12 is defined by a bottom surface 24 and opposite side surfaces 26, 28. Cavities 30, which are spaced apart along the length of the slot 12, extend through openings in respective ones of the side surfaces 26, 28 to openings in a bottom 14 of the housing 10. The cavities 30 are arranged in opposed pairs on respective opposite sides of the slot 12, and the cavities in each of the pairs are mirror images of each other, but are otherwise identical. Contacts 31 and 32, which will be referred to as base contacts and extended contacts, respectively, are disposed in the cavities 30. In the preferred embodiment shown, the contacts 31, 32 are arranged in an alternating sequence in two arrays 51 and 52 which extend along the length of the slot 12. Therefore, pairs of the contacts 31 and 32 are adjacent to each other along the length of the slot 12. Further, the arrays 51, 52 are symmetric about the slot 12 such that like ones of the contacts oppose each other on opposite sides of the slot 12. Alternatively, the arrays 51 and 52 could be staggered with respect to each other such that opposite ones of the contacts 31 and 32 oppose each other on opposite sides of the slot 12. In another embodiment, the arrays 51 and 52 could include the contacts 31 and 32 in different sequences such that there is no correspondence between the arrays.

Referring to FIGS. 2, 3 and 4, the base contacts 31 and the extended contacts 32 are substantially similar in structure and will be described by use of like terms for like structural elements. The contacts 31, 32, which are edge-stamped from a sheet metal blank, have respective leads 33, 34 which extend out from the bottom 14 of the housing for electrical engagement with a circuitboard mothercard (not shown). Each of the contacts includes a base section 35, 36 which is fixed in the housing 10 by a retention section 51, 52 which is preferably a barbed post which interengages in walls of the housing 10. As shown in FIG. 2, the base sections 35, 36 are preferably at a same dimension relatively below the bottom surface 24, although the base sections 35, 36 may be at different relative distances below the bottom surface 24. Each of the contacts 31, 32 further includes an upwardly extending contact beam 37, 38. Each of the contact beams includes, first, a spring section 39, 40 which extends along a course generally upwardly from the base section to a summit 41, 42, and then a contact section 43, 44 sloping generally downwardly from the summit. Each of the contact sections has at its upper end a card-engaging surface 45, 46 which is angularly offset from vertical and is intended to be initially engaged by the daughtercard 4 as the card is inserted into the slot 12. Each of the contact sections has at its lower end a card-contacting surface 47, 48 which is vertical for at least a point and then becomes angled from vertical as it slopes or curves toward a remote end 49, 50 of the contact beam 37, 38. As shown in the drawings, the card-contacting surface 48 of the extended contact 32 has a significantly longer vertical extent than the card-contacting surface 47 of the base contact 31. When the daughtercard 4 is fully inserted in the slot 12, at least one contact point on each of the card-contacting surfaces 47, 48 is electrically mated with a respective one of the contact pads 6.

In the preferred embodiment, the contact beams 37, 38 have a configuration which is substantially S-shaped when the contacts 31, 32 are viewed with their respective retention sections 51, 52 disposed on the left hand side; however, the contact beams 37, 38 may have other suitable configurations. The configuration of the contact beam, including its shape and thickness, determines the spring rate of the contact beam and the stress distribution in the contact beam as the beam is deflected. The beam exerts a normal force on the daughtercard which is a function of the spring rate of the beam multiplied by the deflection of the beam at its point of contact with the card. The configuration of the contact beam is selected to provide a suitable spring rate which will result in a desired minimum normal force on the daughtercard for a given deflection of the contact beam, without overstressing any portion of the contact beam. Since the contact beam 38 is longer and therefore has an inherently lower spring rate than the contact beam 37, it may be desirable for the contact beam 38 to have a thickness $T_2$ which is greater than thickness $T_1$ of the contact beam 37 at a same relative position along the length of the contact beam. Further, the maximum stress point in the contact beam is related to the shape and thickness of the beam. It is preferred that the contact beams configured so that its maximum stress point is in the area where the contact beam 37, 38 joins the base section 35, 36, as this is the strongest and most stable area of the contact beam.

Referring back to FIG. 2, for each of the pairs of contacts 31, 32, the summit 42 of the extended contact 32 is disposed at a greater height above the bottom surface 24 of the slot than the summit 41 of the base contact 31. Also, the card-engaging surface 46 is higher above the bottom surface 24 than the card-engaging surface 45, so that the contacts 31, 32 will not be engaged simultaneously when a daughtercard is inserted into the slot. It is preferred that the card engaging surfaces 45, 46 differ in height above the bottom surface 24 by about 1 mm. Further, the card-contacting surfaces 47, 48 have lowermost ends of substantially identical shape, although facing in opposite directions, and at substantially the same height above the bottom surface 24 in order that contact points on opposite sides of the daughtercard will be at substantially the same height when the card is fully inserted in the slot.

Figure 7:
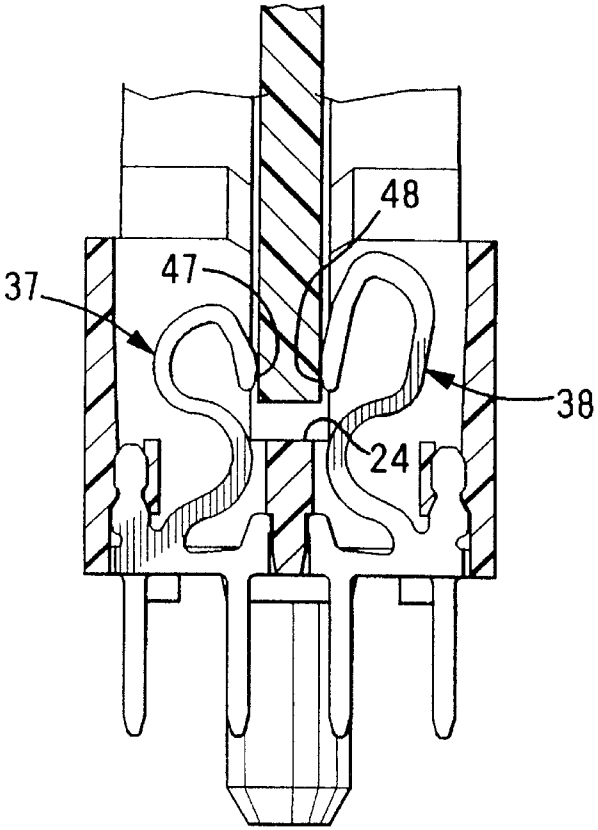
FIGS. 5–7 are cross-sectional views showing a circuit card in successive stages of insertion in the socket.
Figure 6:
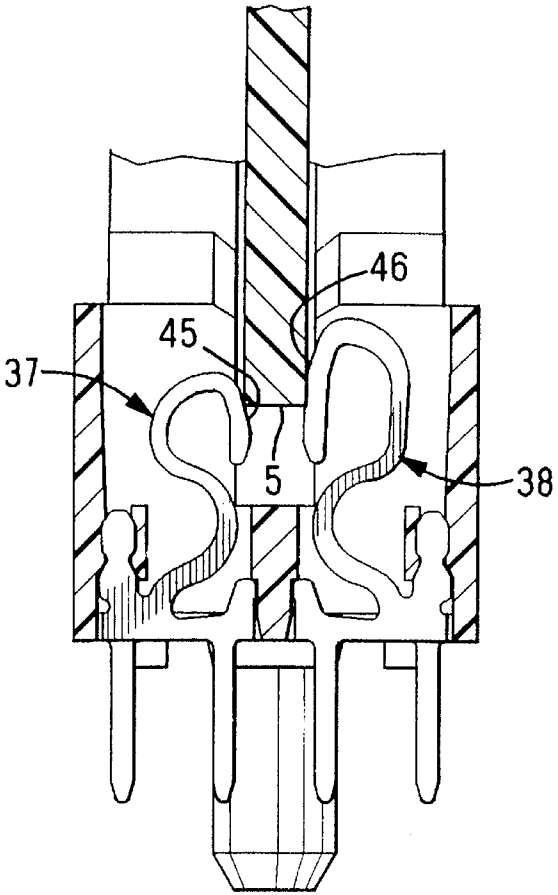
Figure 5:
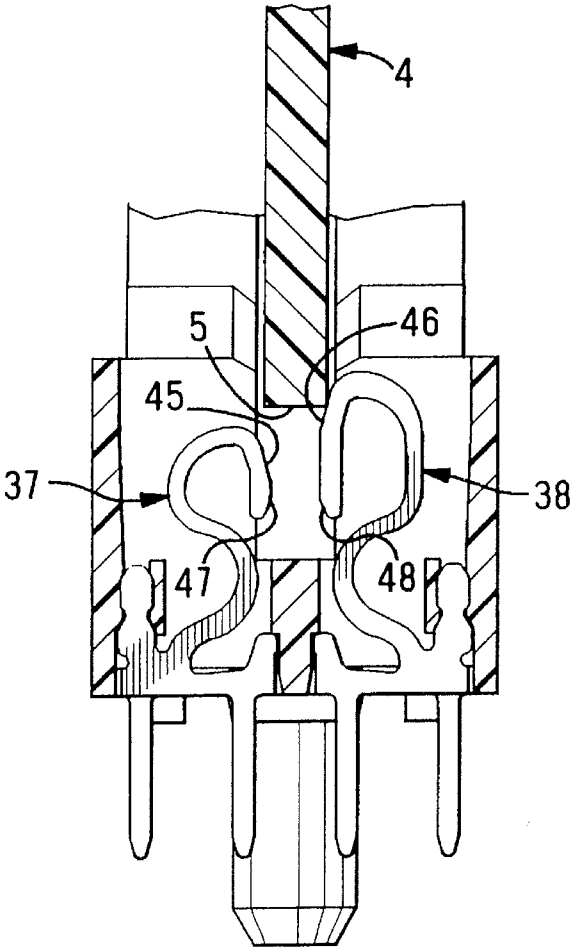
Figure 8:
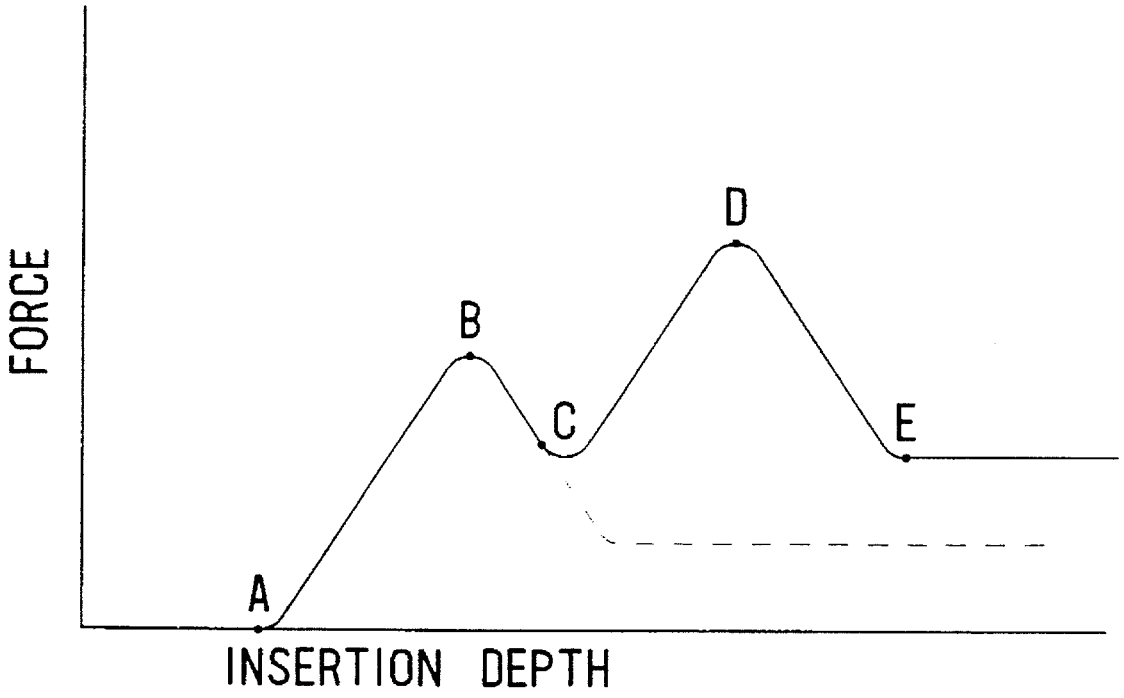
FIG. 8 is a graphical representation of insertion resistance versus insertion depth during insertion of the circuit card into the socket.

FIGS. 5–7 show the daughtercard 4 in successive stages of insertion into the slot 12, and FIG. 8 graphically shows the insertion resistance, which must be overcome by an insertion force on the card, corresponding to the successive stages. In FIG. 5, a corner at the bottom edge 5 of the card 4 begins to engage the card-engaging surface 46 of the extended contact 32, and this corresponds to zero insertion resistance at point A in FIG. 8. Further insertion of the card 4 deflects the contact beam 38 out of the slot 12, and insertion resistance rises to a first peak designated by point B as the contact beam becomes fully deflected. The insertion resistance at all stages up to point B is primarily due to deflection of the contact beam 38, that is, the contact beam exerts an insertion resistance equal to its spring constant multiplied by the beam deflection. Additional insertion resistance arises from frictional resistance between the card and the contact beam. After the contact beam 38 is fully deflected, the insertion resistance decreases on a slope toward a line of constant frictional force which is indicated by the phantom line in FIG. 8. However, the contacts are arranged such that before the line of constant frictional force is reached, the bottom edge 5 of the card will begin to engage the card-engaging surface 45 of the base contact 31 as shown in FIG. 6, which stage corresponds to point C in FIG. 8. Further insertion of the card deflects the contact beam 37 out of the slot 12 and raises the insertion resistance to a second peak, corresponding to point D in FIG. 8, as the beam 37 approaches full deflection. After the contact beams 37, 38 are fully deflected as shown in FIG. 7, which position corresponds to point E in FIG. 8, the insertion resistance becomes a constant value equal to the frictional resistance of the contacts 31, 32 on the daughtercard, during further insertion of the daughtercard until it encounters the bottom 24 of the slot.

As shown graphically in FIG. 8, the greatest magnitude of insertion resistance occurs as the contact beams are being deflected. If all of the contact beams are deflected simultaneously the insertion resistance will exhibit one large peak. By providing extended contacts each having an extended contact beam which will be deflected before the contact beams of the base contacts, two resistance peaks are produced, thereby spreading out the insertion resistance and reducing the magnitude of the greatest resistance peak.

The invention has the advantage of reducing the peak magnitude of insertion resistance in a card edge connector, while allowing all contact points with the circuit card to be maintained at a uniform height from an edge of the card. The invention also has the advantage that base contacts and extended contacts are interchangeable in any of the cavities of the connector so that the base and extended contacts can be arranged in any selected sequence along the length of the slot.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

I claim:

1. A socket for electrically connecting a circuit card to a substrate, comprising:

a dielectric housing defining a card-receiving slot having a bottom surface and a pair of opposite side surfaces;

a plurality of contacts spaced apart along a length of the slot, each of the contacts including a resilient contact beam extending into the slot and having a card-engaging surface which is arranged to be engaged and deflected by a leading edge of the circuit card during insertion of the circuit card into the slot, a card-contacting surface which is arranged for electrically connecting with the circuit card upon full insertion of the circuit card in the slot, the card-engaging surfaces of at least some contact beams being at a greater height above the bottom surface than the card-engaging surfaces of others of the contact beams, all of the card-contacting surfaces being at a same height above the bottom surface;

wherein, during insertion of the circuit card into the slot, the at least some contact beams are engaged and deflected by the circuit card before the others of the contact beams, and upon full insertion of the circuit card in the slot, each of the contact beams has a respective point of contact with the circuit card at said same height.

2. The socket according to claim 1, wherein the at least some and the others of the contact beams are arranged in an alternating sequence along the length of the slot.

3. The socket according to claim 1, wherein the contact beams are arranged in opposed pairs on respective opposite sides of the slot.

4. The socket according to claim 3, wherein the contact beams in each opposed pair extend to a same height above the bottom surface, and the contact beams in adjacent opposed pairs extend to different heights.

5. The socket according to claim 4, wherein each of the at least some contact beams has at least one portion which is relatively thicker than a corresponding portion of each of the other contact beams.

6. A socket for electrically connecting a circuit card to a substrate, comprising:

a dielectric housing defining a card-receiving slot having a bottom surface and a pair of opposite side surfaces, and a plurality of contact-receiving cavities spaced apart along a length of the slot, each of the cavities extending through one of the side surfaces to an exterior of the housing;

a plurality of contacts disposed in respective ones of the cavities, each of the contacts having:

a base;

a lead extending from the base to the exterior of the socket for electrically connecting with the substrate; and, a contact beam extending along a course generally upwardly from the base to a height relatively above the bottom surface and then generally downwardly and inwardly into the slots the contact beam having a card-contacting surface for electrically connecting with the circuit card;

the contact beams being arranged in pairs wherein for each pair, one contact beam extends upwardly to a greater height above the bottom surface than the other contact beam, and the respective card-contacting surfaces of both contact beams are at a same height above the bottom surface, such that during insertion of the circuit card into the slot, the one contact beam is engaged and deflected by the circuit card before the other contact beam, and upon full insertion of the circuit card in the slot, the both contact beams each have a respective point of contact with the circuit card at said same height.

7. The socket according to claim 6, wherein the contact beams of each pair are adjacent to each other along the length of the slot.

8. The socket according to claim 6, wherein the bases of all of the contacts are disposed at a same dimension relatively below the bottom surface of the slot.

9. The socket according to claim 6, wherein for each of the pairs, the one contact beam has at least one portion which is relatively thicker than a corresponding portion of the other contact beam.

10. A socket for electrically connecting a circuit card to a substrate, comprising:

a dielectric housing defining a card-receiving slot having a bottom surface and a pair of opposite side surfaces, and a plurality of contact-receiving cavities spaced apart along a length of the slot, each of the cavities extending through one of the side surfaces to an exterior of the housing;

pairs of contacts disposed in pairs of the cavities, each of the contacts in each of the pairs having:

a base;

a lead extending from the base to the exterior of the socket for electrically connecting with the substrate; and, a contact beam including, first, a spring section extending along a course generally upwardly from the base to a summit which is at a height relatively above the bottom surface, and then a contact section sloping generally downwardly from the summit and inwardly into the slot, the contact section having a card-contacting surface for electrically connecting with the circuit card;

wherein, for each of the pairs of contacts, the summit of one contact is disposed at a greater height above the bottom surface than the summit of the other contact, such that during insertion of the circuit card into the slot, the contact section of the one contact is engaged and deflected by the circuit card before the contact section of the other contact, and wherein the respective card-contacting surfaces of both contacts are at a same height above the bottom surface, such that upon full insertion of the circuit card in the slot, the both contacts each have a respective point of contact with the circuit card at said same height.

11. The socket according to claim 10, wherein the bases of all of the contacts are disposed at a same dimension relatively below the bottom surface of the slot.

12. The socket according to claim 10, wherein for each of the pairs of contacts, the beam of the one contact has at least one portion which is relatively thicker than a corresponding portion of the beam of the other contact.

* * * * *